US007452254B2

(12) United States Patent
Watanabe et al.

(10) Patent No.: US 7,452,254 B2
(45) Date of Patent: Nov. 18, 2008

(54) REMOTE CONTROL UNIT FOR A BOAT

(75) Inventors: Eifu Watanabe, Hamamatsu (JP); Shuji Iekura, Hamamatsu (JP); Masaru Suzuki, Hamamatsu (JP); Masahiko Kato, Hamamatsu (JP); Takashi Okuyama, Hamamatsu (JP)

(73) Assignee: Yamaha Marine Kabushiki Kaisha, Hamamatsu-Shi, Shizuoka-Ken (JP)

( * ) Notice: Subject to any disclaimer, the term of this patent is extended or adjusted under 35 U.S.C. 154(b) by 47 days.

(21) Appl. No.: 11/731,057

(22) Filed: Mar. 30, 2007

(65) Prior Publication Data

US 2007/0249244 A1 Oct. 25, 2007

(30) Foreign Application Priority Data

Apr. 19, 2006 (JP) ..... 2006-115305

(51) Int. Cl.
*B63H 21/21* (2006.01)

(52) U.S. Cl. ..... 440/84

(58) Field of Classification Search ..... 440/84
See application file for complete search history.

(56) References Cited

U.S. PATENT DOCUMENTS 5,127,858 A * 7/1992 Pelligrino et al. ..... 440/84
5,539,294 A 7/1996 Kobayashi
6,085,684 A * 7/2000 Cotton ..... 114/285
6,280,269 B1 8/2001 Gaynor
6,751,533 B2 * 6/2004 Graham et al. ..... 701/21

OTHER PUBLICATIONS

U.S. Appl. No. 11/728,819, filed Mar. 27, 2007, entitled Boat Having Prioritized Controls.
U.S. Appl. No. 11/731,681, filed Mar. 30, 2007, entitled Remote Control Apparatus for a Boat.
U.S. Appl. No. 11/731,691, filed Mar. 30, 2007, entitled Remote Control System for a Watercraft.
U.S. Appl. No. 11/731,422, filed Mar. 30, 2007, entitled Remote Control System for a Boat.
U.S. Appl. No. 11/731,086, filed Mar. 30, 2007, entitled Remote Control Device for a Boat.

* cited by examiner

*Primary Examiner*—Jesús D Sotelo
(74) *Attorney, Agent, or Firm*—Knobbe, Martens, Olson & Bear, LLP

(57) ABSTRACT

A remote control unit can be used for a boat having a plurality of propulsion units to perform output adjustment and tilt/trim angle adjustment of the propulsion units. Operating levers can be capable of forward and backward rotational movement to effect shift operation and throttle operation of the propulsion units and can be respectively provided upright on a left side surface and right side surface of a body. A plurality of tilt/trim angle adjustment switches can correspond to respective propulsion units and can be provided at positions where they can be operated with fingertips of a hand resting on a palm portion of a top surface of the body with the fingertips pointing generally forward. The palm portion of the top surface can be free of switches.

18 Claims, 7 Drawing Sheets

REMOTE CONTROL UNIT FOR A BOAT

CROSS-REFERENCE TO RELATED APPLICATIONS

This application is based on and claims priority under 35 U.S.C. § 119 to Japanese Patent Application No. 2006-115305, filed on Apr. 19, 2006, the entire contents of which is hereby expressly incorporated by reference herein.

BACKGROUND OF THE INVENTIONS

1. Field of the Inventions

The present inventions relate to remote control units configured to control marine propulsion units, and more specifically to a remote control unit for controlling a plurality of propulsion units.

2. Description of the Related Art

Remote control units are often used to control operation of a propulsion unit, such as an outboard motor, of a boat. An operating lever of the remote control unit typically controls shift and throttle operation. An idling button sometimes is located in a side surface of a rotary shaft of the operating lever. Depressing the idling button allows throttle operation to be performed while maintaining the transmission in neutral.

Remote control units can be located at one or more operator's seats, such as a main operator's seat and an upper operator's seat. Remote control units in each location can each be connected to an electronic controller provided in an outboard motor. In some cases, an electrical wire electrically connects various switches on the remote control and an electric actuator arranged near the stern, and a throttle cable, a shift cable, or other such device mechanically connects the electric actuator and an outboard motor. A plurality of outboard motors, two or three for example, are often mounted to the stern of the boat to enable navigation in the event that one of the outboard motors malfunctions.

FIG. 7 illustrates a remote control unit for an electronic remote control system according to U.S. Pat. No. 6,280,269 to Gaynor. Operating levers 52, 52 that are capable of forward and backward rotational movement for effecting the shift and throttle operations of a propulsion unit are provided upright on the left side surface and right side surface of a body 51. Three tilt/trim angle adjustment switches 54P, 54C, 54S are positioned in the upper surface of a horizontal handle 53 of the operating levers 52.

SUMMARY OF THE INVENTIONS

In conventional mechanical remote control systems, such as those described above, the mechanical idling button rotates together with the operating lever as the operating lever is rotated because the idling button is positioned in the side surface of the rotary shaft of the operating lever. Therefore, a finger pressing the idling button also needs to be rotated in accordance with the movement of the operating lever since the idling button only functions while the button is being pressed.

Further, in conventional remote control units for electronic remote control systems, specific switches can perform multiple functions since there is a limited area for placement of switches to perform a plurality of functions. This means that an operator must learn an operation method involving a plurality of modes for realizing various functions, such as operating different kinds of switches in combination. When controlling three or more propulsion units using a pair of left and right operating levers, in particular, the correspondence between the switches positioned on a body of the remote control unit and the operating levers can be complicated and difficult to grasp.

Further, in conventional remote control units for electronic remote control systems, it is not possible to rest a hand on a top surface of the body while no tilt/trim angle adjustment is being performed because the fingers or the palm of the hand come into contact with various switches, indicator lamps, etc. positioned on the top surface of the body when the hand is placed on the top surface of the body.

Therefore, there is a need for a remote control unit for a boat in which the configuration of the body, the layout of various switches, indicator lamps, etc. are improved to facilitate the output adjustment and tilt/trim angle adjustment of a plurality of propulsion units, and a boat equipped with the remote control unit.

A remote control unit for a boat having a plurality of propulsion units can comprise a body having a top surface and a side surface, at least a first operating lever extending from the side surface of the body and adapted for rotational movement for effecting shift operation and throttle operation of the plurality of propulsion units, and a plurality of tilt/trim angle adjustment switches. The plurality of tilt/trim angle adjustment switches can be positioned on the top surface such that each of the tilt/trim angle adjustment switches can be operated by fingertips of a hand resting on the top surface of the body with the palm resting upon a palm portion of the top surface and the fingertips pointing generally forward. Each tilt/trim angle adjustment switch can correspond to a respective propulsion unit. The palm portion of the top surface can be free of switches.

BRIEF DESCRIPTION OF THE DRAWINGS

The abovementioned and other features of the inventions disclosed herein are described below with reference to the drawings of the preferred embodiments. The illustrated embodiments are intended to illustrate, but not to limit the inventions. The drawings contain the following figures.

DETAILED DESCRIPTION OF PREFERRED EMBODIMENTS

Figure 1:
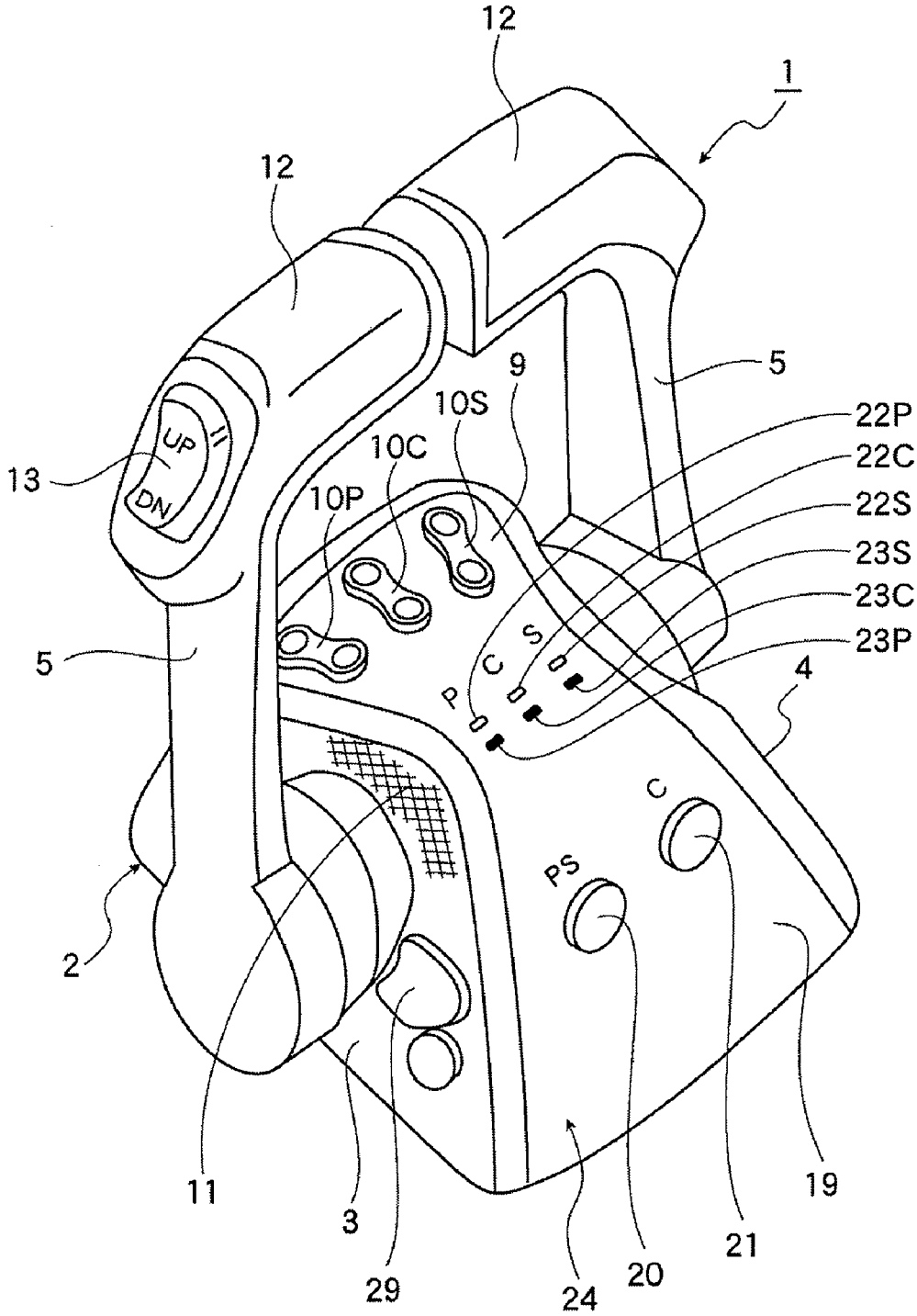
FIG. 1 is a perspective view of a remote control unit according to an embodiment.
Figure 2:
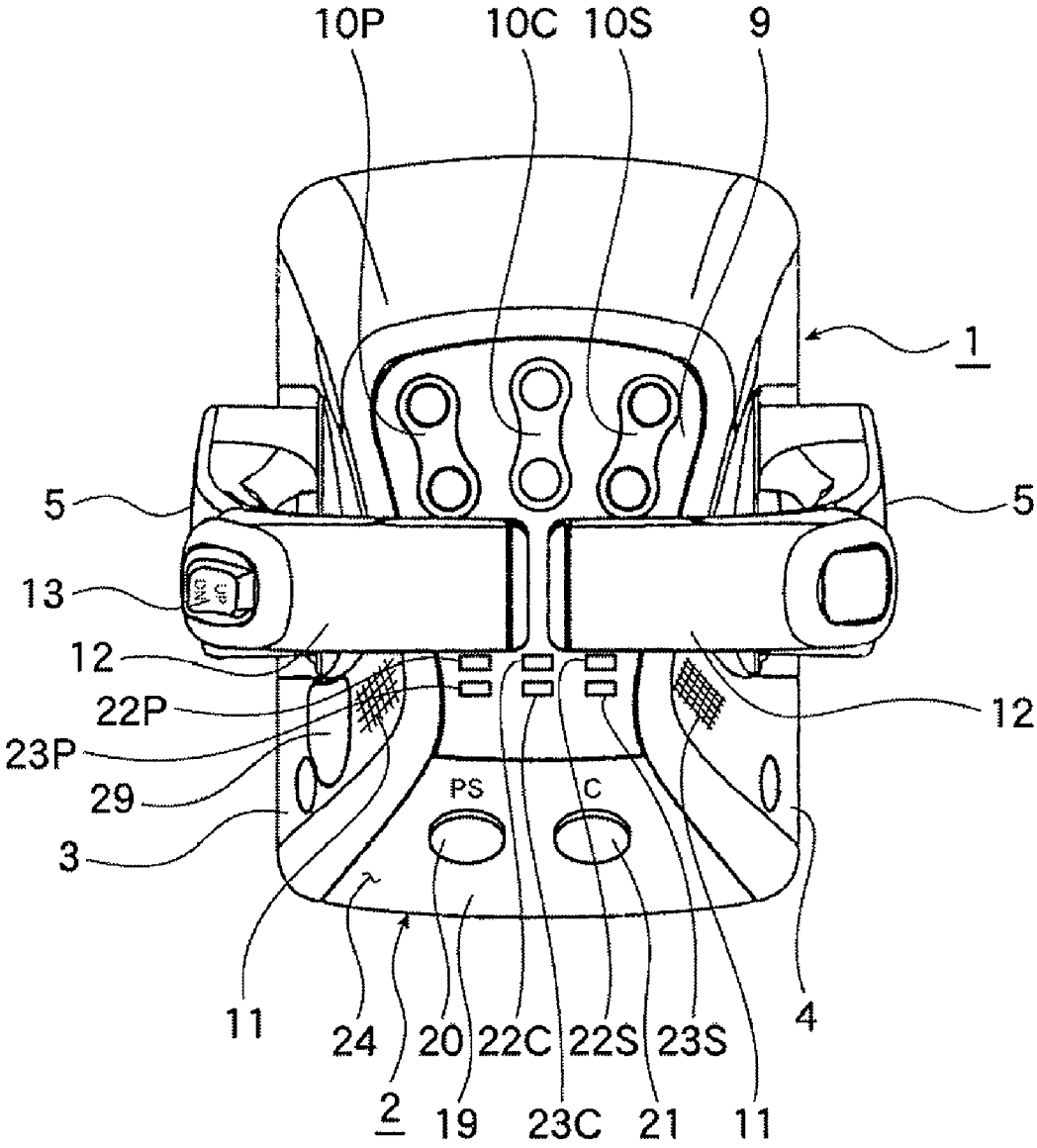
FIG. 2 is a top view of the remote control unit of FIG. 1.
Figure 3:
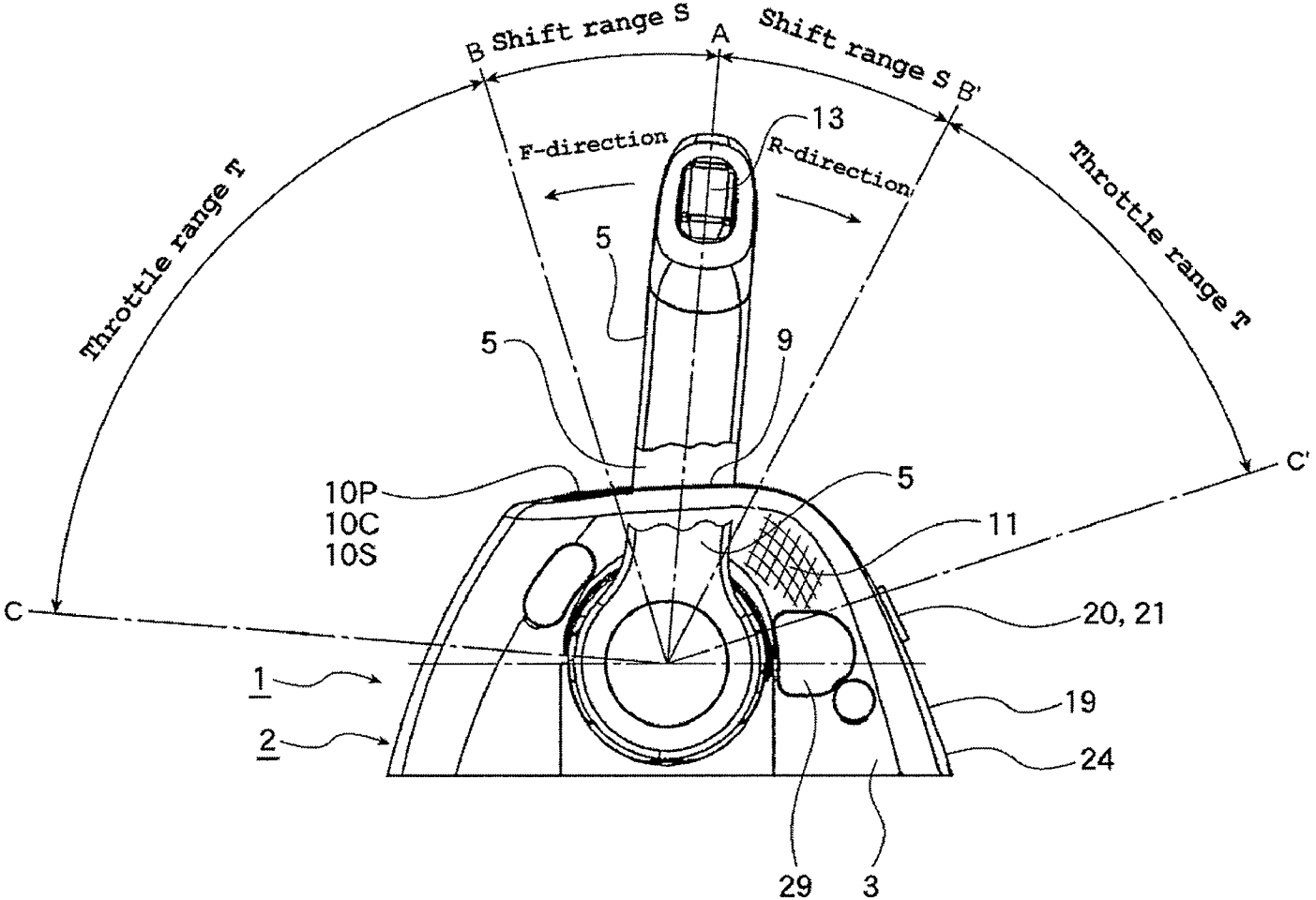
FIG. 3 is a partial left side view of the remote control unit of FIG. 1.

FIGS. 1-3 illustrate a remote control unit 1 according to one embodiment of the present invention. The embodiments disclosed herein are described in the context of a marine propulsion system of a watercraft because these embodiments have particular utility in this context. However, the embodiments and inventions herein can also be applied to other marine vessels, such as personal watercraft and small jet boats, as well as other land and marine vehicles. It is to be understood that the embodiments disclosed herein are exemplary but non-limiting embodiments, and thus, the inventions disclosed herein are not limited to the disclosed exemplary embodiments.

The remote control unit 1 can have a body 2. The body 2 can be mounted onto a table in front of a control panel provided on a front surface of the operator's seat of a boat or onto the deck near the operator's seat. The body 2 preferably is shaped generally like a truncated square cone or pyramid. The corner portions corresponding to its edges can be sufficiently rounded to avoid injury to the human hand or the like.

Operating levers 5, 5, which can be capable of forward and backward rotational movement for effecting the shift and throttle operations of a plurality of propulsion units such as outboard motors, can be provided upright on a left side surface 3 and right side surface 4 of the body 2.

As shown in FIG. 3, a neutral position A of the operating lever 5 can be a generally vertical position. A shift range S can extend over a predetermined range from the neutral position A. When the operating lever 5 is moved through the shift range S only shift operation is performed, and the throttle valve is kept in a fully closed state (idling state). A throttle range T can extend beyond the shift range S. When the operating lever is moved through the throttle range T, the throttle valve can be operated between a fully closed state and a fully open state while keeping the shift state constant.

Figure 4:
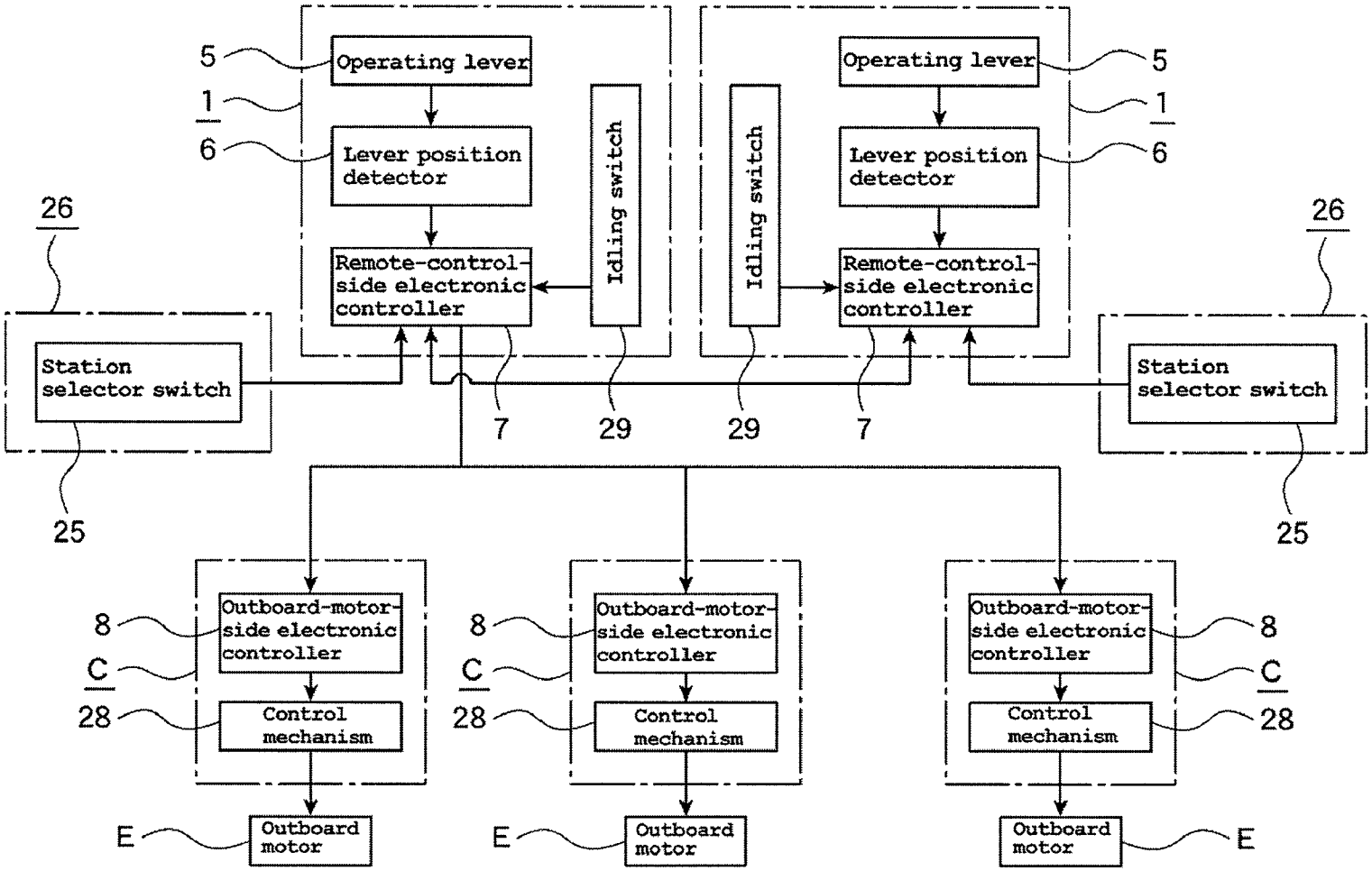
FIG. 4 is a schematic diagram showing a configuration of an electronic remote control system according to an embodiment.

Referring to the schematic diagram of the configuration of an electronic remote control system of FIG. 4, a boat according to one embodiment can be provided with a main operator's seat provided at the central portion of the boat, and an upper operator's seat which can be located above this main operator's seat. Further, the main operator's seat and the upper operator's seat can be respectively provided with separate remote control units 1, 1 having the same configuration and function.

Further, a lever position detector 6 that can detect the rotational position of the operating lever 5 can be provided inside the body 2 of each of the remote control units 1, 1. The position of the operating lever 5 can be sequentially detected by the lever position detector 6. In the embodiment illustrated in FIG. 4, the resulting detection value can be sent to an outboard-motor-side electronic controller 8 of a controller C of an outboard motor E via a remote-control-side electronic controller 7. In the illustrated embodiment, the remote control units 1, 1 communicate with one another, and only one of the units 1 communicates with the controllers C. In other embodiments, both or all remote control units may communicate with the controllers C.

In the remote control unit 1 according to the embodiment illustrated in FIGS. 1-3, tilt/trim angle adjustment switches 10P, 10C, 10S corresponding to respective port, center, and starboard propulsion units, respectively, can be positioned such that these switches can be operated with fingertips of a hand resting on a top surface 9 of the body 2 with the fingertips pointing generally forward. A palm portion of the top surface upon which the user's palm rests preferably is free of switches. Three propulsion units can be controlled by the pair of left and right operating levers 5, as shown in FIG. 4.

The three tilt/trim angle adjustment switches 10P, 10C, 10S can be arranged in parallel so as to diverge radially from the rear to the front of the top surface 9 in conformity with the shape of the hand, as illustrated in FIGS. 1-2. Thus, each tilt/trim angle adjustment switch 10P, 10C, 10S can extend between a rear end and a front end and the separation between the front ends of the plurality of tilt/trim angle adjustment switches can be greater than the separation between the rear ends. These arrangements can allow the respective tilt/trim angle adjustment switches 10P, 10C, 10S to come into contact with the tips of the index, middle, and ring fingers more naturally when a hand is rested on the top surface 9 of the body 2 with the fingertips pointing generally forward.

Accordingly, when a hand is resting on the top surface 9 of the body 2 with the palm facing down, the tilt/trim angle adjustment switches 10P, 10C, 10S corresponding to the respective propulsion units, can be in contact with the fingertips, while the portion in contact with the palm can be free of switches to avoid accidental operation of switches while enhancing operator comfort and steadiness in operating the switches. The tilt/trim angle of each propulsion unit can be thus properly adjusted, and also the top surface 9 of the body 2 can be safely used as a hand rest when no tilt/trim angle adjustment is being performed. Further, when a hand rests on the top surface 9 of the body 2 with the palm facing down in order to operate the tilt/trim angle adjustment switches 10P, 10C, 10S corresponding to the respective propulsion units, the tilt/trim angle adjustment switches 10P, 10C, 10S preferably come into contact with the fingertips in a natural position, thereby allowing the tilt/trim angles of the respective propulsion units to be adjusted without unnecessary movement. In one embodiment, the palm portion of the top surface 9 can include one or more indicator lamps. In another embodiment, the palm portion of the top surface 9 is devoid of indicator lamps as well as switches.

As seen in FIG. 2, the top surface 9 can have a substantially sector-like or trapezoidal shape that is narrower in the rear than in the front. The size of the top surface 9 can be such that when the remote control unit 1 is arranged on the right side of the operator's seat, the left side surface 3 and right side surface 4 of the main portion 2 can be pinched near the rear of the top surface 9 by the thumb and the little finger in such a way that the left side surface 3 of the body 2 can be contacted by the thumb and the right side surface 4 can be contacted by the little finger. Naturally, when the remote control unit 1 is arranged on the left side of the operator's seat, the left side surface 3 of the body 2 can be contacted by the little finger and the right side surface 4 can be contacted by the thumb near the rear of the top surface 9.

Accordingly, when a hand rests on the top surface 9 of the body 2 with the palm facing down, the hand can be supported by the thumb and the little finger with respect to the body 2, thereby allowing the tilt/trim angles of the respective propulsion units to be adjusted with greater accuracy even when the boat's posture is not steady.

It should be noted that while the body 2 can be assembled by combining injection molded parts made of synthetic resin materials, at least the portions of the body 2 where the thumb and the little finger come into contact with the left side surface 3 and right side surface 4 of the body 2 are preferably embossed with minute surface irregularities 11 to provide an anti-slip effect.

Horizontal handles 12, 12 can be provided above the operating levers 5, 5. A main tilt/trim angle adjustment switch 13 for adjusting the tilt/trim angles of the three propulsion units at once can be provided in the side surface of one of the horizontal handles 12, 12.

Figure 5:
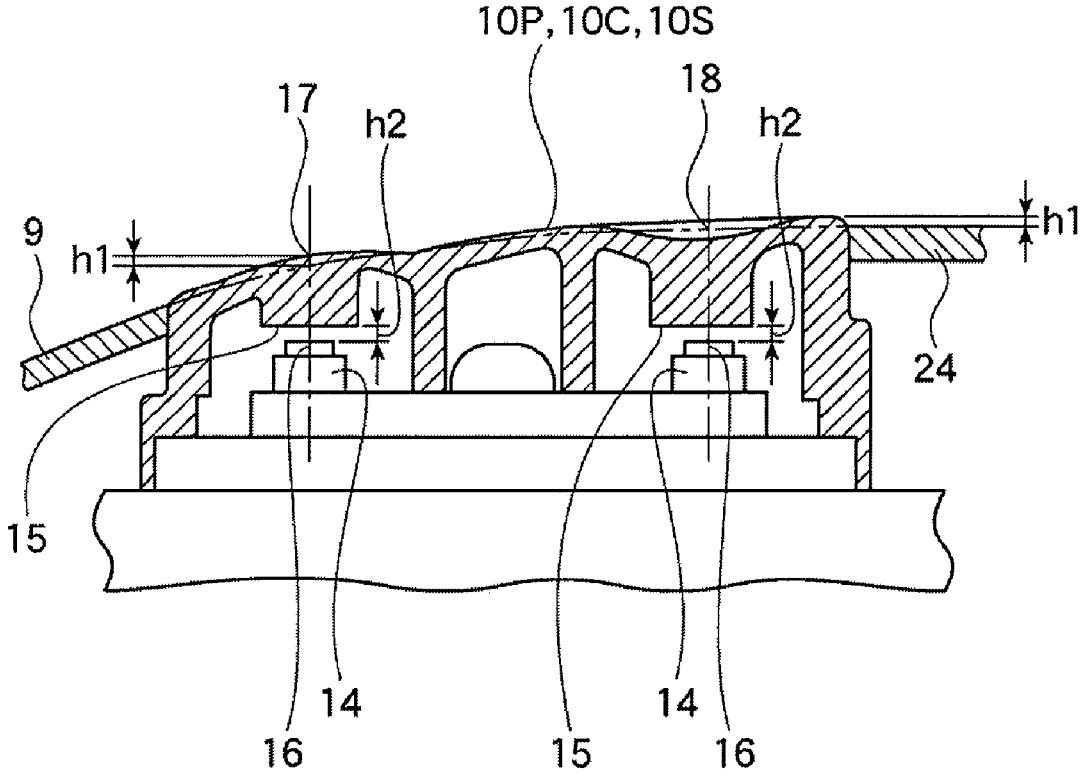
FIG. 5 is an enlarged partial cross-sectional view of a tilt/trim angle adjustment switch and a top surface of the body of a remote control unit according to an embodiment.

Referring to FIG. 5, at the boundary between the three tilt/trim angle adjustment switches 10P, 10C, 10S and the body 2, the tilt/trim angle adjustment switches 10P, 10C, 10S can protrude slightly from the top surface 9 of the body 2, thus allowing the positions of these switches to be located by touching them with a hand without visual checking. A projection dimension h1 is defined from the top surface 9 of the body 2 to a top of each switch 10. A gap dimension h2 is defined between lower end surfaces 15, 15 on the inner side of the respective tilt/trim angle adjustment switches 10P, 10C, 10S and distal end surfaces of contacts 16 of contact members 14, 14. These dimensions can be determined such that when adjusting the tilt/trim angles of the propulsion units, the contact members 14 incorporated in the body 2 can be activated by pressing the respective tilt/trim angle adjustment switches 10P, 10C, 10S downward from the top surface 9 of the body 2. As in the illustrated embodiment, the projection dimension h1 and the gap dimension h2 can be substantially the same.

The tilt/trim angle adjustment switches 10P, 10C, 10S can be configured so as to increase the tilt/trim angle of the propulsion units upon depressing the front side of the tilt/trim angle adjustment switches 10P, 10C, 10S, and so as to decrease the tilt/trim angle of the propulsion units upon depressing the rear side thereof. Further, in the illustrated embodiment, a projection 17 can be formed in the portion of the top surface on the front side of each of the tilt/trim angle adjustment switches 10P, 10C, 10S, and a depression 18 can be formed in the top surface on the rear side thereof, thereby allowing the operator to discern whether the switch is to be operated to increase the tilt/trim angle or to decrease the tilt/trim angle by touching the projections and depressions. Further, to prevent the contact members 14, which can be incorporated in the body 2 and correspond to each of the tilt/trim angle adjustment switches 10P, 10C, 10S, from coming into contact with water, the contact members 14 can be covered by an integrally molded part made of an elastic synthetic resin material that is open at the bottom and can block the contact members 14 from the outside air.

With reference again to FIGS. 1-3, a left-right control switch 20 configured to control each of a port-side propulsion unit and a starboard-side propulsion unit, and a center control switch 21 configured to control a center propulsion unit can be provided on a back surface 19 side of the body 2. Operation of these switches will be discussed in more detail below.

Behind the portion of the top surface 9 of the body 2 which comes into contact with the palm, there can be provided activation indicator lamps 22P, 22C, 22S indicative of a normal activation state and alarm indicator lamps 23P, 23C, 23S indicative of an abnormal activation state, which respectively correspond to the port-side propulsion unit, the center-broadside propulsion unit, and the starboard-side propulsion unit.

In the illustrated embodiment, the portion from the top surface 9 to back surface 19 of the body 2 can be covered with a single semi-transparent panel 24 formed so as to have a substantially L-shaped cross section as shown in FIG. 3. The activation indicator lamps 22P, 22C, 22S and the alarm indicator lamps 23P, 23C, 23S can be located inside the panel 24, while the light from these lamps can be visually observed from the outside. This allows the normal activation state or abnormal activation state of each propulsion unit to be recognized easily.

In one embodiment, remote control units 1 can be positioned near each of the main operator's seat and the upper operator's seat. The two remote control units 1, 1 can have the same structure and function, and can be adapted so that either one of the remote control units 1, 1 becomes active when in use.

As shown in FIG. 4, a station selector switch 25 for activating one of the plurality of remote control units 1 provided in the same boat can be provided in a separate, independent switch board 26 such as a main switch board arranged near each of the remote control units 1. Since only the switches that are frequently used during operation such as the tilt/trim angle adjustment switches 10P, 10C, 10S are located in the body 2, and the station selector switch 25 that is not frequently used during operation can be located somewhere other than the body 2, the functions performed by the plurality of individual switches on the body 2 can be more easily discerned, thereby achieving an improvement in operability.

The indicator lamps 22P, 22C, 22S can turn off when the remote control unit 1 is not active.

Although a preferred embodiment has been described with reference to a remote control unit used in a boat equipped with three propulsion units, in other embodiments a boat can be equipped with two or four propulsion units or more. The number of the tilt/trim angle adjustment switches provided in the top surface 9 of the body 2 can be two or four or more in accordance with the number of propulsion units.

The remote control unit 1 can be connected to a control mechanism 28 configured to perform the shift and throttle operations and tilt/trim angle adjustment of the outboard motor E via the outboard-motor-side electronic controller 8 provided in the outboard motor E, as illustrated in FIG. 4.

Accordingly, upon operating the operating lever 5, a command signal of the remote-control-side electronic controller 7 that has received a signal from the lever position detector 6 corresponding to the operating position of the operating lever 5 can be transmitted to the control mechanism 28 via the outboard-motor side electronic controller 8, and a shifter (not shown) for switching between the forward rotation, reverse rotation, and neutral position of the propeller of the outboard motor E can be activated. Further, upon performing throttle operation using the operating lever 5, a command signal of the remote-control-side electronic controller 7 that has received a signal from the lever position detector 6 corresponding to the operating position of the operating lever 5 can be transmitted to the control mechanism 28 via the outboard-motor side electronic controller 8, and the opening of the throttle valve (not shown) of the engine of the outboard motor E can be determined.

An idling switch 29 can be provided in either one of the left side surface 3 and right side surface 4 of the body 2. The idling switch 29 preferably switches between an idling state and a normal state of operation. When in the idling state, throttle operation can be performed while maintaining the transmission in neutral. When in the normal state, throttle and shift operation can be performed in the manner discussed above with the description of FIG. 3.

The idling switch 29 can switch between the idling state and the normal state through opening/closing of an electrical circuit. Once switched to the idling state, the idling switch 29 can maintain the idling state unless the idling switch 29 is pressed for switching to the normal state. Unlike mechanical idling switches, the idling switch 29 can thus maintain the idling state without being constantly pressed. Therefore, unlike a mechanical remote control system, the idling switch 29 does not rotate as the operating lever 5 is rotated, so a finger pressing the idling switch 29 need not be rotated together with the idling switch 29. Further, since a layout similar to that of a mechanical remote control system can be used, operation of the operating lever 5 and the idling switch 29 at the same time does not feel improper.

Referring to FIG. 4, the switch board 26 can include the station selector switch 25. The station selector switch 25 can select, from among the plurality of remote control units 1, the remote control unit 1 whose activation signal is to be received by the controller 8. For example, to activate the remote control unit 1 in the main operator's seat, the station selector switch 25 installed in the main operator's seat can be activated, and the resulting signal can be sent to the remote-control-side electronic controller 7 of the remote control unit 1 installed in the main operator's seat.

As a result, a signal transmitted from the remote-control-side electronic controller 7 of the remote control unit 1 installed in the upper operator's seat can be blocked by the remote-control-side electronic controller 7 of the remote control unit 1 in the main operator's seat, and the signal from the remote control unit 1 in the main operator's seat can be transmitted to the outboard-motor-side electronic controller 8 in the outboard motor E and can be then transmitted to the control mechanism 28, thereby executing shift/throttle operation and tilt/trim angle adjustment.

As shown in FIG. 3, the operating lever 5 can be in the neutral, forward, and reverse positions when located at the positions A, B, and B', respectively. When the operating lever 5 is rotated from the position B to the position C, the shifter (not shown) preferably remains unaffected while the throttle valve is controlled by the remote-control-side electronic controller 7 and the outboard-motor-side electronic controller 8 so as to change from the fully closed (idling) position to fully open position in the normal mode, change from the fully closed (idling) position to intermediate opening position in the low speed mode, and keep the fully closed (idling) position in the shift mode.

On the other hand, when the operating lever 5 is rotated from the position B' to the position C', the shifter can remain unaffected while the throttle valve can be controlled by the remote-control-side electronic controller 7 and the outboard-motor-side electronic controller 8 so as to change from the fully closed (idling) position to fully open position.

The position of the operating lever 5 can be sequentially detected by the lever position detector 6, and the resulting detection value can be sent to the remote-control-side electronic controller 7 and the outboard-motor-side electronic controller 8 via an electrical wire. The operation for returning the operating lever 5 toward the position A can be the reverse of the operation described above.

When the projection 17 in the top surface located on the front side of each of the tilt/trim angle adjustment switches 10P, 10C, 10S is pressed downward, the resulting signal can be sent via the remote-control-side electronic controller 7 to the outboard-motor-side electronic controller 8 of the controller C of the outboard motor E corresponding to the operated switch, and an actuator (not shown) for adjusting tilt/trim angle, which is a component of the control mechanism 28, can be activated, causing the tilt/trim angle of the outboard motor E to increase. Further, upon pressing the depression 18 in the top surface located on the rear side, the resulting signal can be sent via the remote-control-side electronic controller 7 to the outboard-motor-side electronic controller 8 of the controller C of the outboard motor E corresponding to the operated switch, causing the tilt/trim angle of the outboard motor E to decrease.

Figure 6:
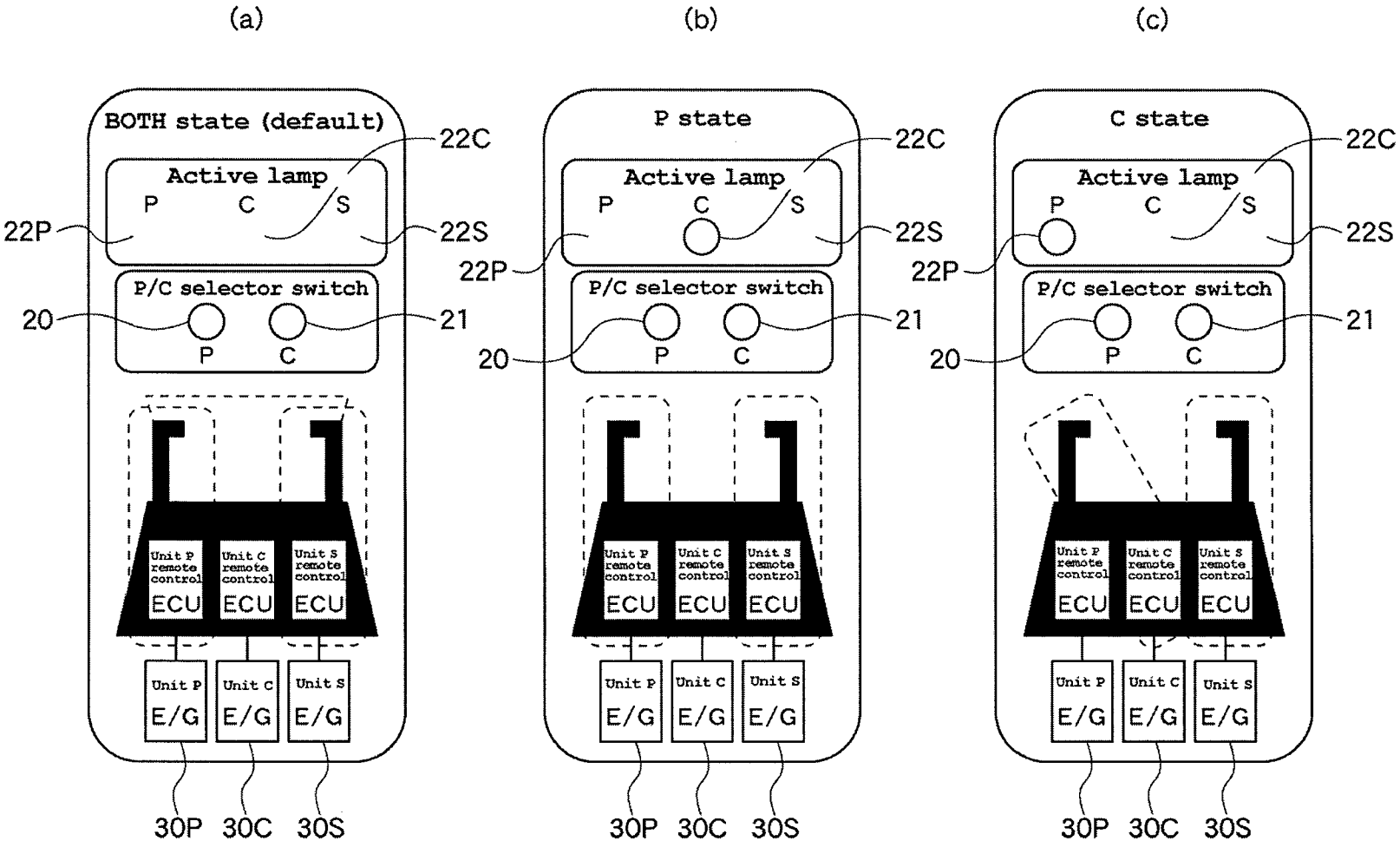
FIG. 6 is a diagram illustrating a method of using a remote control unit according to an embodiment with three propulsion units.
Figure 7:
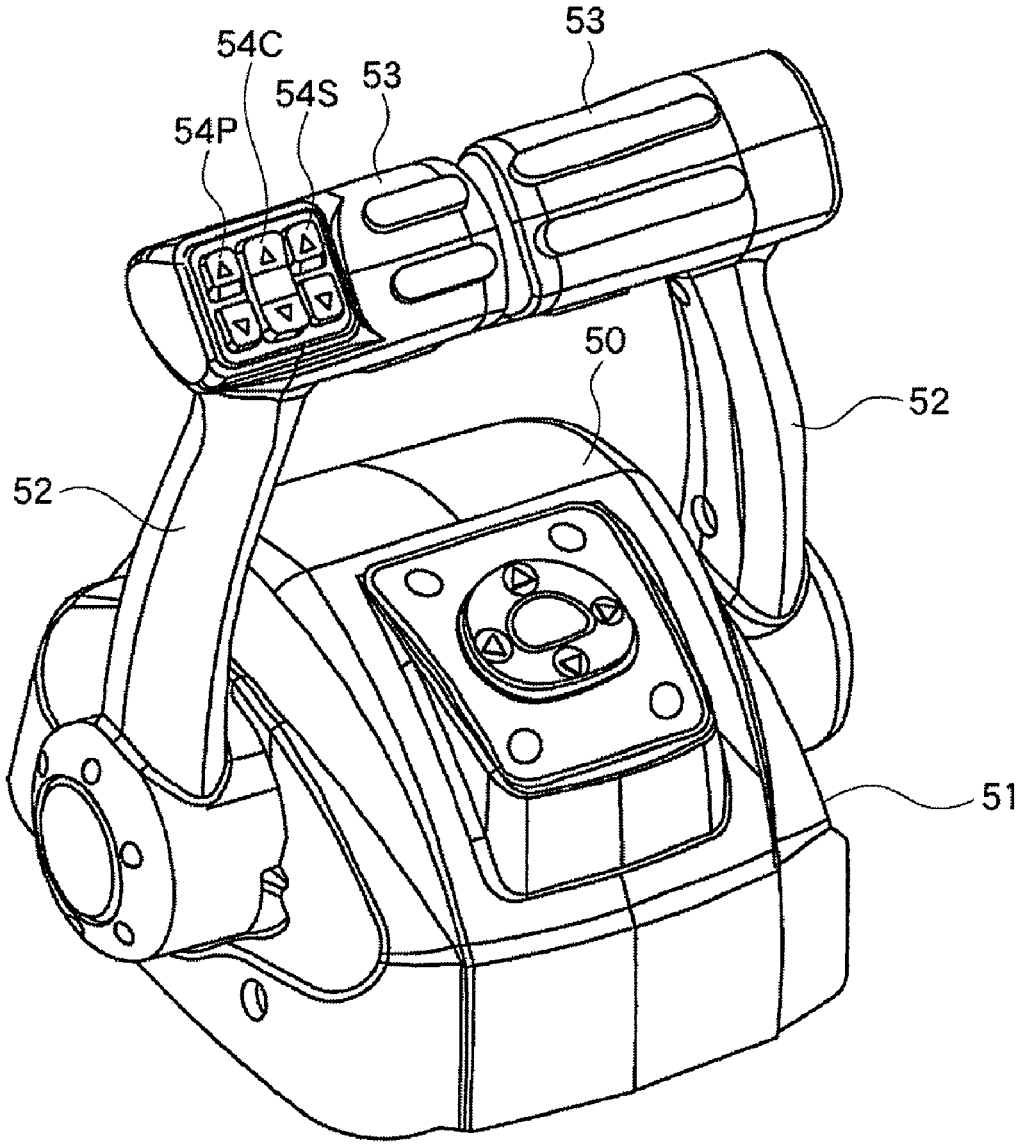
FIG. 7 is a perspective view of a conventional remote control unit.

As shown in FIG. 6(*a*), in an initial state, a port-side propulsion unit 30P, a center propulsion unit 30C, and a starboard-side propulsion unit 30S can all be active, so the activation indicator lamps 22P, 22C, 22S can all be turned on.

Next, upon pressing the left-right control switch 20 in the initial state, as shown in FIG. 6(*b*), the center propulsion unit 30C can stop and the activation indicator lamp 22C can turn off, while the port-side propulsion unit 30P and the starboard-side propulsion unit 30S can remain active and the activation indicator lamps 22P and 22S remaining on. Upon pressing the left-right control switch 20 in this state, the center propulsion unit 30C can be activated and the activation indicator lamp 22C can turn on, so that the port-side propulsion unit 30P, center propulsion unit 30C, and starboard-side propulsion unit 30S are all active, and the activation indicator lamps 22P, 22C, 22S are all on.

Upon pressing the center control switch 21 in the initial state, as shown in FIG. 6(*c*), the port-side propulsion unit 30P can stop and the activation indicator lamp 22P can turn off, while the center propulsion unit 30C and the starboard-side propulsion unit 30S can remain active and the activation indicator lamps 22C and 22S remain on. Upon pressing the center control switch 21 in this state, the port-side propulsion unit 30P can be activated and the activation indicator lamp 22P can turn on, so that the port-side propulsion unit 30P, center propulsion unit 30C, and starboard-side propulsion unit 30S are all active, and the activation indicator lamps 22P, 22C, 22S are all on.

Alternatively, the center control switch 21 can be configured such that upon pressing the center control switch 21, the starboard-side propulsion unit 30S can stop and the activation indicator lamp 22S can turn off, while the center propulsion unit 30C and the port-side propulsion unit 30P can remain active and the activation indicator lamps 22C and 22P remain on. Upon pressing the center control switch 21 in this state, the starboard-side propulsion unit 30S can be activated and the activation indicator lamp 22S can turn on, so that the port-side propulsion unit 30P, center propulsion unit 30C, and starboard-side propulsion unit 30S are all active, and the activation indicator lamps 22P, 22C, 22S are all on. Furthermore, the center control switch 21 and/or the left-right control switch 20 can be configured to function in other manners.

As described above, the remote control unit 1 can enable operation of the operating levers 5, 5 simultaneous with selective use of the left-right control switch 20 and the center control switch 21, thereby allowing management of the kind of operation being performed with respect to each propulsion unit.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combinations or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A remote control unit for a boat having a plurality of propulsion units, comprising a body having a top surface and a side surface, at least a first operating lever extending from the side surface of the body and adapted for rotational movement for effecting shift operation and throttle operation of the plurality of propulsion units, and a plurality of tilt/trim angle adjustment switches positioned on the top surface such that each of the tilt/trim angle adjustment switches can be operated by fingertips of a hand resting on the top surface of the body with the palm of the hand resting upon a palm portion of the top surface and the fingertips pointing generally forward, each tilt/trim angle adjustment switch corresponding to a respective propulsion unit, wherein the palm portion of the top surface is free of switches.

2. The remote control unit of claim 1, wherein each tilt/trim angle adjustment switch extends between a rear end and a front end, and wherein the separation between the front ends of the plurality of tilt/trim angle adjustment switches is greater than the separation between the rear ends.

3. The remote control unit of claim 1, wherein the top surface has a generally trapezoidal shape that is narrower at a rear end than at a front end, and is sized so that a left side surface and a right side surface of the body can be pinched near the rear end of the top surface by the thumb and the little finger of a hand resing on the top surface to operate the plurality of tilt/trim angle adjustment switches.

4. The remote control unit of claim 1, wherein the plurality of tilt/trim angle adjustment switches protrude from the top surface of the body, each tilt/trim angle adjustment switch being configured to activate a contact member within the body when pressed downward.

5. The remote control unit of claim 1, further comprising an activation indicator lamp indicative of a normal activation state and an alarm indicator lamp indicative of an abnormal activation state corresponding to each of the plurality of propulsion units.

6. The remote control unit of claim 1, further comprising at least a second operating lever, the first and second operating levers configured to control three propulsion units, the remote control unit further comprising a left-right control switch on a rear surface of the body for selectively disengaging a center propulsion unit while maintaining operation of a port-side propulsion unit and a starboard-side propulsion unit, and a center control switch on a rear surface side of the body for selectively disengaging one of the port-side and starboard-side propulsion units.

7. The remote control unit of claim 1, further comprising an idling switch on one of a left side surface and a right side surface of the body.

8. A system comprising a plurality of remote control units according to claim 1 for use in a single boat and a station selector switch for selecting among the plurality of remote control units located in a separate, independent switch board positioned near each of the remote control units.

9. The remote control unit of claim 1 in combination with a boat.

10. The combination of claim 9, further comprising a plurality of propulsion units.

11. A boat comprising a plurality of propulsion units and at least one remote control unit, the at least one remote control unit comprising a body having a top surface and a side surface, at least a first operating lever extending from the side surface of the body and adapted for rotational movement for effecting shift operation and throttle operation of the plurality of propulsion units, and a plurality of tilt/trim angle adjustment switches positioned on the top surface such that each of the tilt/trim angle adjustment switches can be operated by fingertips of a hand resting on the top surface of the body with the palm of the hand resting upon a palm portion of the top surface and the fingertips pointing generally forward, each tilt/trim angle adjustment switch corresponding to a respective propulsion unit, wherein each tilt/trim angle adjustment switch extends between a rear end and a front end, and wherein the separation between the front ends of the plurality of tilt/trim angle adjustment switches is greater than the separation between the rear ends.

12. The boat of claim 11, wherein the palm portion of the top surface is free of switches.

13. The boat of claim 11, wherein the top surface has a generally trapezoidal shape that is narrower at a rear end than at a front end, and is sized so that a left side surface and a right side surface of the body can be pinched near the rear end of the top surface by the thumb and the little finger of a hand resting on the top surface to operate the plurality of tilt/trim angle adjustment switches.

14. The boat of claim 11, wherein the plurality of tilt/trim angle adjustment switches protrude from the top surface of the body, each tilt/trim angle adjustment switch being configured to activate a contact member within the body when pressed downward.

15. The boat of claim 11, further comprising an activation indicator lamp indicative of a normal activation state and an alarm indicator lamp indicative of an abnormal activation state corresponding to each of the plurality of propulsion units.

16. The boat of claim 11, further comprising at least a second operating lever, the first and second operating levers configured to control three propulsion units, the remote control unit further comprising a left-right control switch on a rear surface of the body for selectively disengaging a center propulsion unit while maintaining operation of a port-side propulsion unit and a starboard-side propulsion unit, and a center control switch on a rear surface side of the body for selectively disengaging one of the port-side and starboard-side propulsion units.

17. The boat of claim 11, further comprising an idling switch on one of a left side surface and a right side surface of the body.

18. The boat of claim 11, further comprising a plurality of remote control units and a station selector switch for selecting among the plurality of remote control units located in a separate, independent switch board positioned near each of the remote control units.

* * * * *

UNITED STATES PATENT AND TRADEMARK OFFICE

CERTIFICATE OF CORRECTION

PATENT NO. : 7,452,254 B2
APPLICATION NO. : 11/731057
DATED : November 18, 2008
INVENTOR(S) : Eifu Watanabe et al.

It is certified that error appears in the above-identified patent and that said Letters Patent is hereby corrected as shown below:

Column 9, line 11, in Claim 3, delete “resing” and insert -- resting -- therefor.

Signed and Sealed this

Twenty-third Day of June, 2009

John Doll

JOHN DOLL
*Acting Director of the United States Patent and Trademark Office*